US006348760B1

(12) United States Patent
Vollkommer et al.

(10) Patent No.: US 6,348,760 B1
(45) Date of Patent: Feb. 19, 2002

(54) FLAT SIGNALING LAMP WITH DIELECTRICALLY IMPEDED DISCHARGE

(75) Inventors: Frank Vollkommer, Buchendorf; Lothar Hitzschke, Munich, both of (DE)

(73) Assignee: Patent-Treuhand-Gesellschaft fur Elektrische Gluhlampen mbH, Munich (DE)

( * ) Notice: Subject to any disclaimer, the term of this patent is extended or adjusted under 35 U.S.C. 154(b) by 0 days.

(21) Appl. No.: 09/367,539

(22) PCT Filed: Dec. 11, 1998

(86) PCT No.: PCT/EP98/08104

§ 371 Date: Aug. 16, 2000

§ 102(e) Date: Aug. 16, 2000

(87) PCT Pub. No.: WO99/34410

PCT Pub. Date: Jul. 8, 1999

(30) Foreign Application Priority Data

Dec. 23, 1997 (EP) ..... 97122798

(51) Int. Cl.[7] ..... H01J 65/00; H01J 60/02

(52) U.S. Cl. ..... 313/493; 313/573; 313/634; 40/557; 40/545

(58) Field of Search ..... 313/493, 491, 313/492, 573, 574, 631, 634; 40/557, 545, 612

(56) References Cited

U.S. PATENT DOCUMENTS

| | | | | |
|---|---|---|---|---|
| 5,479,071 A | | 12/1995 | Lynn | |
| 5,514,934 A | * | 5/1996 | Matsumoto et al. | 313/493 X |
| 5,777,431 A | * | 7/1998 | Maya et al. | 313/493 |
| 6,114,809 A | * | 9/2000 | Winsor | 313/493 X |

FOREIGN PATENT DOCUMENTS

| | | |
|---|---|---|
| DE | 195 26 211 | 1/1997 |
| EP | 0 766 286 | 4/1997 |

* cited by examiner

*Primary Examiner*—Ashok Patel
(74) *Attorney, Agent, or Firm*—Frishauf, Holtz, Goodman, Langer & Chick, P.C.

(57) ABSTRACT

What is described is a flat signal lamp with dielectrically impaired discharge, which is intended in particular for use in traffic signals, above all traffic lights.

17 Claims, 4 Drawing Sheets

FLAT SIGNALING LAMP WITH DIELECTRICALLY IMPEDED DISCHARGE

FIELD OF THE INVENTION

The present invention relates to the field of signal lamps of the kind used above all for traffic signals and traffic signs. In particular, it pertains to a traffic light.

The field of lamp technology includes not only manifold lighting tasks but also the field of signal lamps. The term signal lamp should be understood primarily as a lamp that makes the observer aware (informs him) about an event or situation. This information is imparted to the observer as a rule already by whether the lamp is on or off. Furthermore, the lamp can provide the observer with additional information content, for instance by way of its shape, color or captioning.

In daily life, there are many familiar applications of signal lamps, such as in road traffic and in travel by ship and railroad; for monitoring and operating technical devices of every kind; for safety-related signage in buildings or in such traffic-related, commercial or industrial systems as airports, railroad stations, motion picture theaters, and so on.

The field of signal lamps is characterized by some special requirements. These include reliability, service life, and the expense for repair and maintenance. This is due not only to safety considerations but also to the large numbers of signal lamps in use and their wide geographic distribution, with the attendant expense for maintenance and repair.

Another important aspect is that for signal lamps, certain structural forms or sizes are desired, depending on the intended application.

STATE OF THE ART

Conventionally, standard incandescent bulbs or halogen lamps are used, especially for signal lamps that have to be turned on and off in operation.

The resultant disadvantages are, first, the high vulnerability to vibration of the incandescent filament. Particularly for applications in the traffic field, this entails major restrictions. Furthermore, depending on the type of lamp and the operating voltage used, incandescent bulbs have only a relatively limited service life of a few thousand hours and must then be replaced, at sometimes considerable effort and expense, as already noted above. In the final analysis, the service life is typically short, which is just as much a disadvantage as any other vulnerability to defects.

Another aspect often arises from the special demands made of the projection characteristics of the projected radiation. In that case, the incandescent bulbs must be installed in an optical system, for instance with a mirror reflector and/or with lenses. First, this can lead to maladjustments and attendant radiant power limitations. Furthermore, such optical systems are complicated in structure and in principle are vulnerable to soiling; yet soiling, especially in the traffic field, is fundamentally unavoidable. As a result, complicated internal cleaning during regular maintenance work is necessary, but even then it is impossible to entirely restore the initial properties of the system.

In mirror reflectors, so-called phantom lights can also occur, e.g., when the sun is low in the sky, in traffic lights. Reflected sunlight makes it look as though the signal lamp is lighted when it is not.

A further disadvantage of the optical systems with reflectors or lenses that are often needed in applications using incandescent bulbs are the required structural size and shape and the attendant weight. In many cases these are highly undesirable, above all if the bulb or lamp has to be mounted in special positions, thus requiring considerable effort for installation and/or for the appropriate mounts, masts or other kinds of securing devices. Yet there is no other choice, giving the necessity of illuminating a large signalling area or of a particular projection direction specified by particular standards, for instance.

A final aspect is the development of temperature in incandescent bulbs, which is not only very great overall but also is highly localized. The resultant thermal cycles and thermal gradients put a burden on the bulb or lamp and its technological surroundings, especially in non-stationary operating states. The outcome is a relatively restricted resistance to reliability in switching.

One known possible way of overcoming some of the disadvantages discussed is to use light-emitting diodes (LEDs); however, they are often unsuitable because of their characteristics of the emitted radiation. Another disadvantage is that the color locus, which is important in many signal lamp applications and also is often standardized, is either not adjustable or, if fluorescent materials are used, cannot be adjusted permanently because of stability problems.

DESCRIPTION OF THE INVENTION

The technical problem on which the invention is based is to disclose a novel signal lamp which offers opportunities for overcoming the aforementioned difficulties.

According to the invention, this problem is solved by a gas discharge lamp having a discharge vessel which is at least partly transparent to visible radiation and is filled with a gas fill, and having a dielectric layer between at least one discharge electrode and the gas fill for a dielectrically impaired or hindered discharge in the discharge vessel, characterized in that the lamp is a signal lamp with a signal surface, and the discharge vessel has a continuous boundary surface that corresponds to the signal surface.

The invention is based on the recognition that many conventional prejudices against the use of gas discharge lamps in the field of signal lamp technology can either be overcome technologically, or else the attendant disadvantages are tolerable because of other attendant advantages. One factor arguing against the use of gas discharge lamps instead of incandescent bulbs or halogen lamps is the necessity of using expensive starting circuits or electronic ballasts. On the other hand, precisely in the field of electronic ballasts, substantial progress has been made in lowering the cost and reducing the structural size, and in the field of conventional halogen lamps as well, by use of transformers in low-voltage technology similar disadvantages are accepted.

Another aspect is the reduced resistance to repeated switching of gas discharge lamps because of the starting process. It has been found here that with gas discharge lamps with dielectrically hindered discharge, resistances to repeated switching can be attained that far exceed those of conventional incandescent bulbs and that are determined essentially only by the stability of the fluorescent materials, or mixtures thereof, that are employed. Because of the relatively insensitive electrode form compared with incandescent filaments and because there are fewer thermal cycles in operation, the resistance to repeated switching can now be assessed as an advantage of gas discharge lamps with dielectrically impaired discharge, compared with conventional incandescent bulbs. Here again, a prejudice prevailing in conventional gas discharge lamp technology has proved in this special case to be unfounded.

Another aspect that initially argues against the use of discharge lamps is associated with the widespread use of mercury in the corresponding gas fills. Mercury not only has disadvantageous environmental aspects but also leads to disadvantageous temperature properties of the bulb or lamp. Primarily, this means its instant-start properties, that is, the (lack of an) ability to emit the full light output immediately after being turned on. Furthermore, this problem also depends on outside temperatures and is accordingly especially pronounced in cold surroundings. It has now been demonstrated, however, that if a lamp with dielectrically impaired discharge is used, gas fills containing mercury are no longer necessary, and so these problems vanish completely.

One substantial advantage of this invention resides in the geometry, particularly of flat radiating discharge lamps, which is very flexibly adaptable in shape and size to individual requirements. Discharge lamps are distinguished by a largely homogeneous distribution of light generation over the discharge volume, so that often additional optical components can be dispensed with. The mirror reflectors, for instance, that create the problematic phantom light in traffic lights and the additional baffles used to reduce the phantom light are unnecessary. Instead, by means of the flat radiating discharge lamp alone, a substantially better outcome in terms of the phantom light effect can be attained than if these components are used in the conventional way, and the result is a substantial contribution to traffic safety.

It is true that mirror reflectors have made it possible to adjust the directional distribution of light projection very well and to select this distribution. In this respect, there have been reservations against gas discharge lamps, especially if additional mirror reflectors are omitted, on the grounds that overly imprecise projection into the hemisphere, for instance, is obtained, thus yielding an inadequate light density in the actually decisive directions. However, as discussed below, according to the invention possible ways have been found for concentrating the light density distribution, if that is necessary in a particular application, even with flat radiating gas discharge lamps.

By omitting mirror reflectors, baffles and other separate optical components, it also becomes unnecessary any longer to adhere to the specifications, developed above all in the prior art, in terms of the external shape of the signal lamp or signal light and pertaining for instance to a certain minimum thickness, the at least preferred use of a round outer shape, and so forth. The same is true for weight reduction.

Correspondingly, the problems of internal soiling of signal lamps, such as traffic lights, discussed at the outset also disappear. Since with a suitable choice of the fluorescent material or mixture of fluorescent materials a great many color loci can be selected, the conventionally required filter disks can often be omitted. Not only is there a gain in light yield, but even more important, internal cleaning becomes entirely unnecessary. Given a suitably tight or encapsulated embodiment of the signal lamp of the invention, the external cleaning that is occasionally needed can be accomplished especially simply, for instance by shooting a jet of water at it, even from a relatively great distance.

In conjunction with economizing on the conventionally required reflectors, filter disks and so forth, it is another advantage of the invention that the complicated positional adjustment of the incandescent bulb or its base, which must be done because of the shifting caused by the thermal cycles in operation, or at least when the incandescent bulb is changed, is also no longer necessary.

Fluorescent lamps are also fundamentally less sensitive to vibration than incandescent bulbs, and for that reason alone are already much better suited for installation locations of signal lamps, especially in the traffic field, that are exposed to various kinds of mechanical jarring or vibration.

This invention pertains above all to flat radiating discharge vessels, in which a continuously shallow form of the discharge volume dictates the shape of the flat radiator lamp directly, or at least substantially. In contrast, conventional tubular discharge vessels, which illuminate a flat scattering disk from behind, for instance, when they are coiled or laid in serpentine fashion to fill up the area to be lighted from behind, are not continuously flat discharge vessels. Naturally, the flat radiator lamp can nevertheless have corrugated surfaces or be curved at its surface.

The signal surface recited in claim 1 is the surface used for performing the signal function of the signal lamp. It may have a signal color or written captions, danger symbols, and so forth. This signal surface need not be identical with the associated boundary surface of the discharge vessel and can be separated from it for instance by various intermediate optical layers. The signal surface is illuminated or lighted from behind, at least in substantial portions, by the boundary surface and at least in this sense is equivalent to the boundary surface.

The signal surface and the corresponding boundary surface are also preferably substantially congruent geometrically.

In a preferred embodiment of the invention, the electrodes of the flat radiation discharge vessel are disposed on one of its surfaces, and in particular in such a way that the electrodes extend side by side. By jointly disposing them on one surface of the discharge vessel, it becomes possible to produce the lamp especially simply, because only one surface has to be coated with electrode structures. Furthermore, discharge structures that fill the space especially uniformly can be created thereby. This will become clear from the description of the exemplary embodiment that follows later herein.

In this preferred form of the discharge electrodes, the discharge anodes and discharge cathodes comprising a plurality of parallel-extending discharge anodes and discharge cathodes can furthermore be connected jointly on one common side (that of the anodes or of the cathodes, respectively) and connected to a single anode and cathode terminal, respectively. In particular, as shown for the exemplary embodiment, a rectilinear form of the discharge anodes and discharge cathodes may be imagined, with common terminals on opposite sides leading to an arrangement of the discharge anodes and discharge cathodes that mesh in comb-like fashion.

For the sake of improved control and thus greater uniformity of the arrangement of individual discharges or the discharge structure in the discharge volume, protrusions may be provided on the electrodes for the sake of locally defining at least a single discharge element, or in other words a single discharge from the plurality of discharges. In this respect as well, reference is made to the exemplary embodiment.

In the dielectrically impaired discharge, at least the anode side must be covered with a dielectric layer. The dielectric layer, also recited in the main claim, can also, however, be formed by one wall of the discharge vessel, if at least some of the electrodes are applied to the outside of that wall.

In many cases, above all if the light projection is intended to be to only one side, the use of a reflection layer on a discharge vessel wall is contemplated, specifically for the sake of diffuse reflection of the light from the lamp, in contrast to the mirror reflector. Typically, gas discharge lamps include fluorescent layers on the walls of the discharge vessel, and in that case the reflection layer should be located on the side of the fluorescent layer remote from the discharge. The use of a fluorescent material is not compulsory for this invention, however. If dielectrically impaired discharges in which the desired light is generated directly in the discharge are desired, then the invention can also be performed even without fluorescent material.

The projection performance of gas discharge flat radiator lamps is fundamentally relatively diffuse, or in other words is oriented in all the exit directions out of the plane of the flat radiating lamp. This is equally true in the case of the optional use of a diffuse reflection layer. For some applications, a further embodiment of the invention is preferable, in which the angular region in space of the light projection, which region substantially (for a one-sided reflection layer) encompasses the hemisphere, is restricted to a narrower angular region in space. According to the invention, light density enhancement layers, and in particular Fresnel lenses or prism foils or prism plates, are used as simple, flat optical elements on the flat radiating lamp. In particular, so-called brightness enhancement foils (brightness enhancers) can be used as the prism foils; they narrow the light outlet cone to a single dimension, or if two brightness enhancement foils intersecting at right angles in the longitudinal direction of their prism are used, then they narrow it to two dimensions. Such brightness enhancement foils will be described in further detail below in conjunction with the exemplary embodiment. The light density enhancement layers, however, may also be constructed without prisms, for instance with a variation of the index of refraction.

A diffuse-scattering foil or plate can also be used, if a prism foil is logically used on the bulb side of it at the same time. Such a diffuser is advantageous above all whenever a relatively large area of the discharge vessel is stabilized by means of support points, or in other words small posts extending transversely to the plane of the flat radiator lamp between the plates that enclose the discharge volume. Because of the diffuser, the support points are visually less conspicuous.

As a preferred discharge system for the discharge lamp, described here largely with respect to its geometrical and electrotechnical layout, the xenon excimer system can be considered. This system is preferably used with a pulsed discharge mode. For the details of xenon excimer discharge lamps and the pulsed discharge mode, see international patent applications WO 94/23442, or DE-P 43 11 197.1, respectively, and WO 97/04625, or DE 19526211.5, respectively, whose disclosure is incorporated by reference herein.

This invention pertains quite generally to signal lamps of every type. Various areas of application have already been described in the introduction. However, it is especially appropriate above all in the traffic field, that is, not only road, railroad and ship traffic but also air traffic. A particular aspect of the invention accordingly pertains to a traffic sign or a traffic signal that includes or comprises a signal lamp according to the invention. Many of the aforementioned advantages of the invention, such as the lower vulnerability to soiling, the phantom light problem, the longer service life, especially in installation locations subject to vibration, the improved resistance to repeated switching, and so forth play an especially important role in the field of traffic signs and traffic signals.

This applies in particular to a traffic light, each of whose two or three different-colored signal lamps is a fluorescent flat radiator lamp according to the invention. The exemplary embodiment also applies to this case. However, another important use is as a vehicle light, such as a brake light or a turn indicator, which can also be installed extending around a corner of the vehicle and thus can be curved for that purpose. In all these cases, as in general in signal lamps, it is especially advantageous that the often standardized color or more precisely the color locus can already be set by means of the correct choice of a fluorescent material or a mixture of fluorescent materials. Not only does this present especially good technical options for precise adjustment of the color locus, but the conventional color filter technology often becomes superfluous as well.

DESCRIPTION OF THE DRAWINGS

A description of the preferred exemplary embodiment, namely a signal lamp for a traffic light, follows. This exemplary embodiment is shown in the drawings; specifically:

In FIG. 1, a round signal lamp 1 for a traffic light is shown. The sectional view shows the discharge volume within the smallest circle 2. Sections through support points 3, disposed in a square pattern 34 mm on a side, are shown as small round dots. The region between the smallest circle 2 and the middle-sized circle 4 represents the lateral sealing off of the discharge volume from the outside world. The outer circle 5 is the outer edge of panes of glass 6 and 7 that define the discharge volume at the top and bottom (that is, in terms of the view of the drawing). These panes of glass are shown in section in FIG. 2. In this exemplary embodiment, the diameters of the three circles 2, 4 and 5 are 200, 220, and 240 mm respectively.

FIG. 2 shows a section in a direction at right angles to FIG. 1. A xenon discharge fill is enclosed between the two glass plates 6 and 7. Typical thicknesses for the glass plates are 2.5 mm each and for the gas fill 8, approximately 5 mm. Silver electrodes 9 are first shown in cross section on the lower glass plate 7; their geometry will be described in further detail in conjunction with FIG. 3. A glass solder layer 10, which forms the dielectric of the dielectrically impaired discharge, is located on the electrodes 9. It is followed by a reflector layer 11 of $Al_2O_3$ or $TiO_2$ for the sake of diffuse reflection of the light generated in the lamp 1.

Above the reflector layer 11 is a fluorescent layer 12 for light generation. An identical fluorescent layer 12 is also located on the underside of what in this view is the top glass plate 6. These fluorescent layers are optimized for the particular application, and in particular the desired color locus. For the present example of a traffic light, preferred fluorescent materials or combinations thereof are found in European Patent Application 97 122 800.2, filed by the present Applicant on the same date and entitled "SIGNAL LAMP AND FLUORESCENT MATERIALS THEREFOR", whose disclosure content is hereby incorporated by reference.

In some applications, for instance for the red light of the traffic light, it may be appropriate to provide a color filter 13 on the glass plate 6; see the above-cited application.

Figure 1:
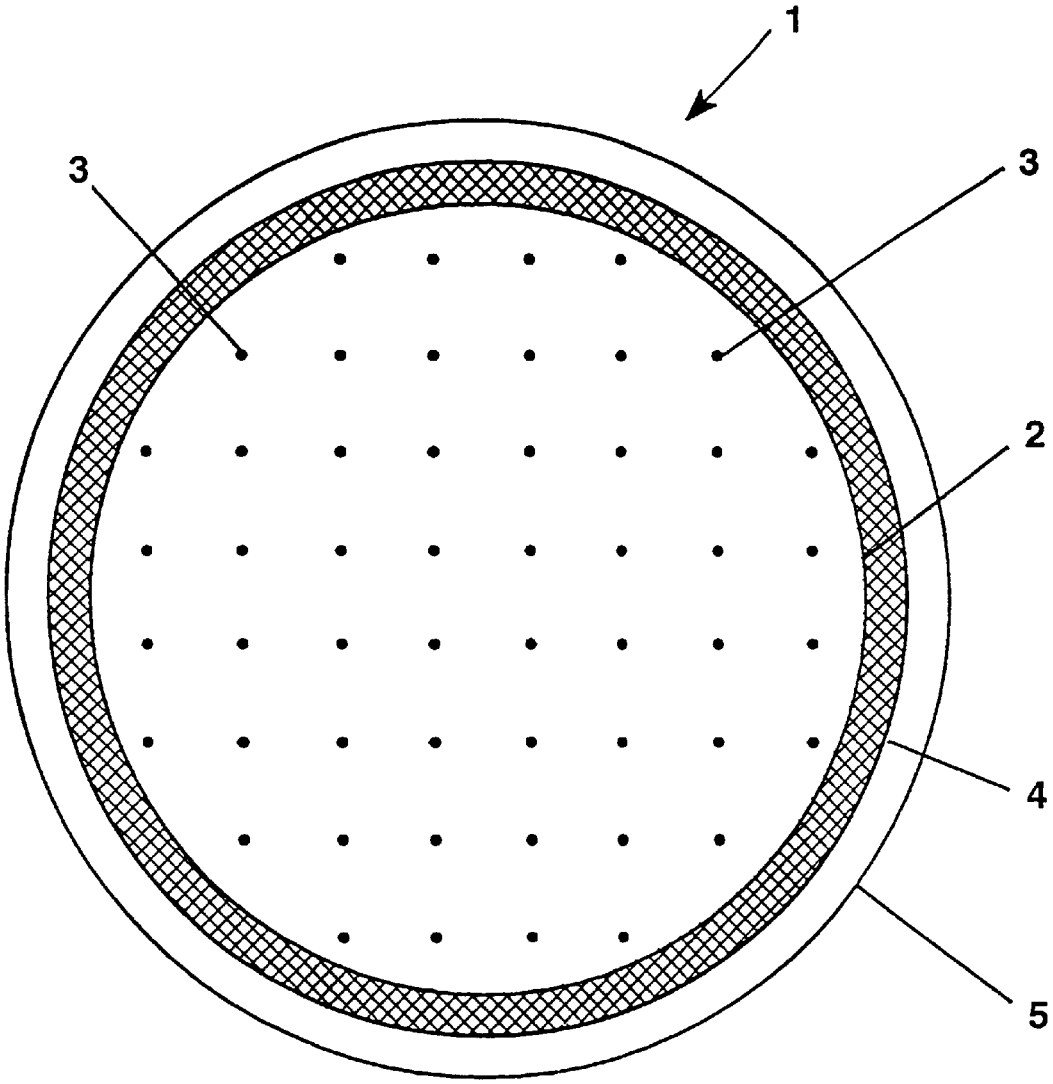
FIG. 1 is a plan view in section on the signal lamp for a traffic light.

Above the glass plate 6 and the optical color filter 13 is a diffuser 14; it diffusely scatters the light, generated by the fluorescent layers 12 and reflected by the reflector layer 11, to such an extent that the support points, which can be seen in FIG. 1, are now only slightly perceptible in the pattern of light produced by the signal lamp.

The electrodes and layers 9 through 12 applied to the glass plates 6 and 7 can be produced especially simply by screen printing. The screen printing method is advantageous, among other purposes, for structuring the electrodes. For the sake of simplicity, it will also be employed for the other layers.

Two light density enhancement foils 15 and 16 interacting at right angles in their longitudinal prism direction are in turn located over the optional color filter 13 and the diffuser 14. Such light density enhancement foils are prism foils, which by refraction of the light at the faces of the prism bring about a narrowing of the projection cone of the light in the plane at right angles to the longitudinal prism axis.

One example of this is the "brightness enhancement" foils that are commercially available from the manufacturer 3M. The positioning angle of the prisms can be optimized for a given application, so that the projected light will be aligned to the required extent.

In this exemplary embodiment, the signal face is the fluorescent surface on the upper light density enhancement foil 16. The signal function is reduced to whether the red, yellow or green signal lamp 1 light up. On the other hand, the boundary face of the discharge vessel, which in the sense of claim 1 corresponds to the signal surface, is the upper glass plate 6. Aside from the interposition of various optical layers, these surfaces correspond to one another and are congruent.

Figure 3:
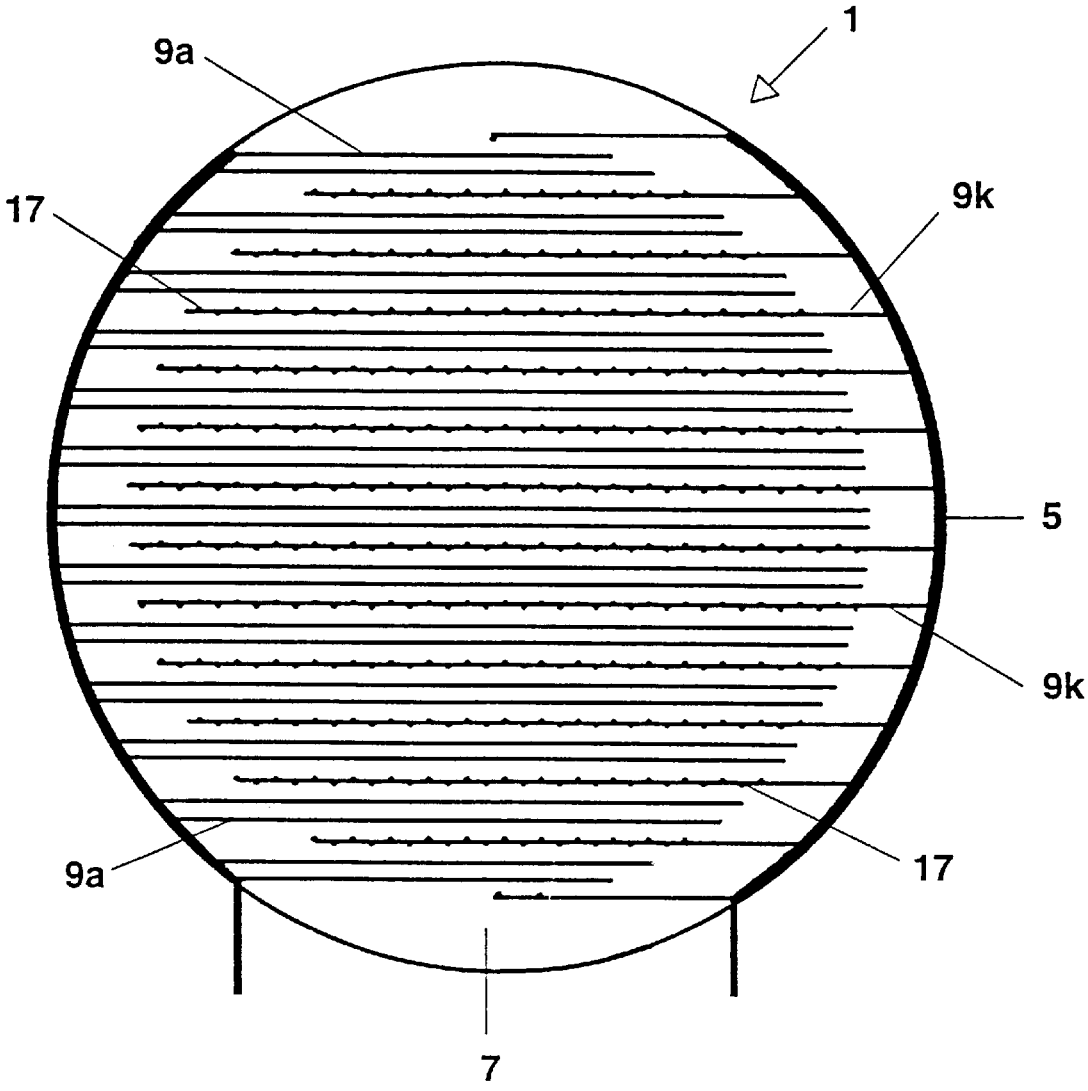
FIG. 3 is a plan view on a bottom plate of the signal lamp, showing the electrode structure.

FIG. 3 shows a plan view, comparable to FIG. 1, but in which only the geometry of the electrodes 9, not visible in FIG. 1, on the lower glass plate 7 is shown. An interlocked basic geometry can be seen that is similar to two straight combs meshing with one another. In this comb-like geometry, the anodes 9*a* shown on the left in the drawing are each located in pairs side by side, while the cathodes 9*k* shown on the right are each located individually between adjacent pairs of anodes. The cathodes 9*k,* along their length, have small protrusions 17 disposed regularly and in alternation on both sides; the protrusions serve the purpose of three- dimensional definition of one individual discharge structure each. For information on this electrode structure, see German Patent Application DE 196 36 965.7, whose disclosure is hereby incorporated by reference. The closest spacing between two spacings, in this exemplary embodiment, is 5 mm, or between protrusions on the same side, 10 mm.

The surface area of the limits of the anode and cathode combs 9*a* and 9*k,* respectively, is equivalent to the inner circle 2 already mentioned in conjunction with FIG. 1. The electrodes are each combined on the left and right sides of the drawing to form a common anode terminal and cathode terminal, respectively, which is located on the outer circumference of the outer circle 5 shown in FIG. 1 as the outer edge of the glass plates. These common terminals, each representing circular segments over the longitudinal extent of the inner circle 2, are extended to the outside, at the bottom in FIG. 3, to a respective anode terminal and cathode terminal.

Figure 4:
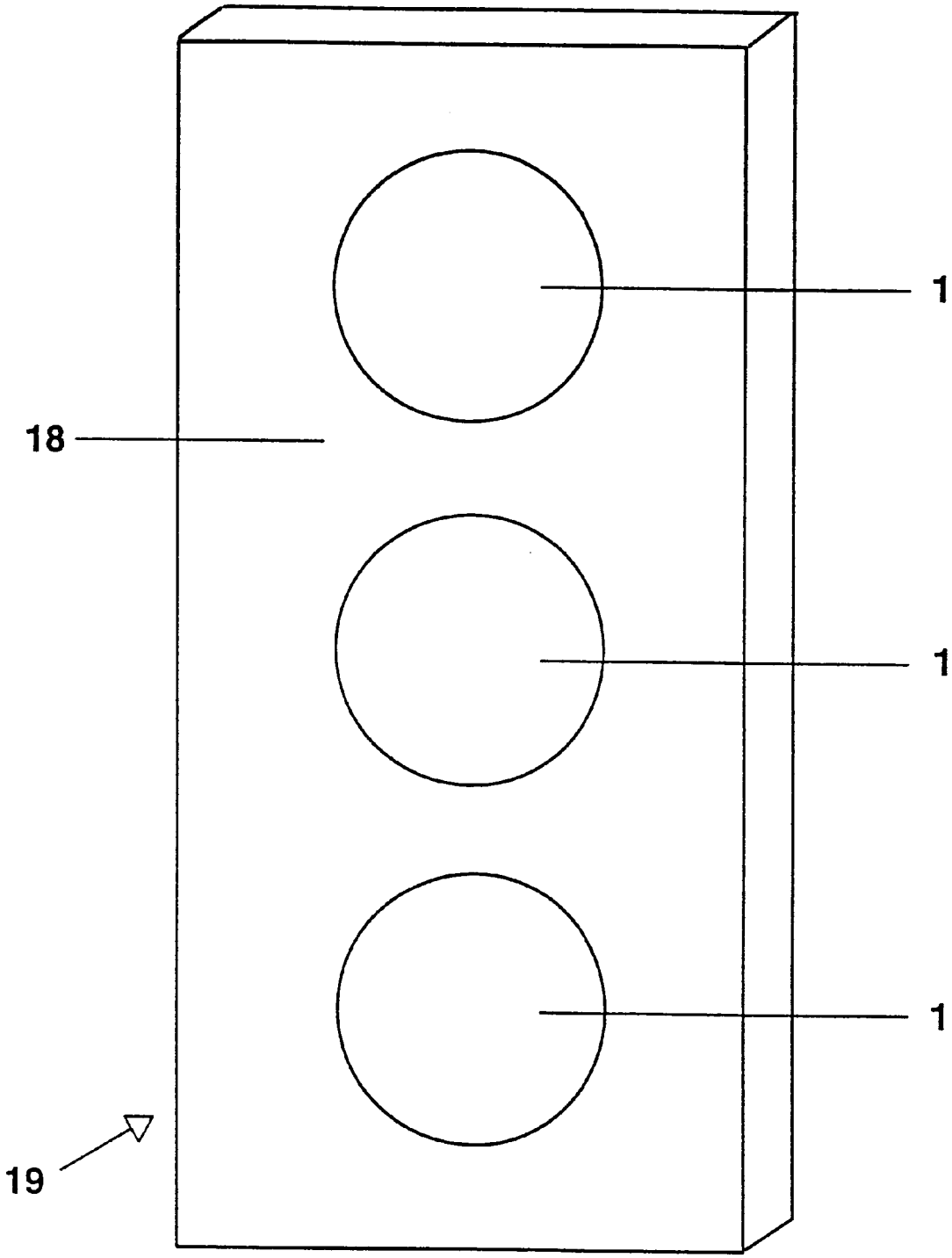
FIG. 4 is a schematic illustration of three signal lamps according to FIGS. 1–3, assembled into a traffic light.

FIG. 4, finally, in a schematic view shows how three of the signal lamps 1 described thus far are combined into a traffic light. Because of the particular structural shape of the individual signal lamps 1, a very shallow housing 18 can be employed, which otherwise has the typical tall rectangular shape. The elements, such as scattering plates, shields and parabolic mirrors, used in conventional traffic lights that have incandescent bulbs can be dispensed with here. Nevertheless, the advantages of the invention already described are attained, and in particular the phantom light effect no longer occurs, because there is no mirror reflector that could reflect the sunlight shining in obliquely. A traffic light 19 of this kind could be secured to a very simple, easily constructed stanchion, but because of its low weight it could also readily be hung from cables, and especially because of the substantial simplifications in terms of weight and volume and the great freedom with respect to the housing 18, it offers manifold possibilities for use.

Figure 2:
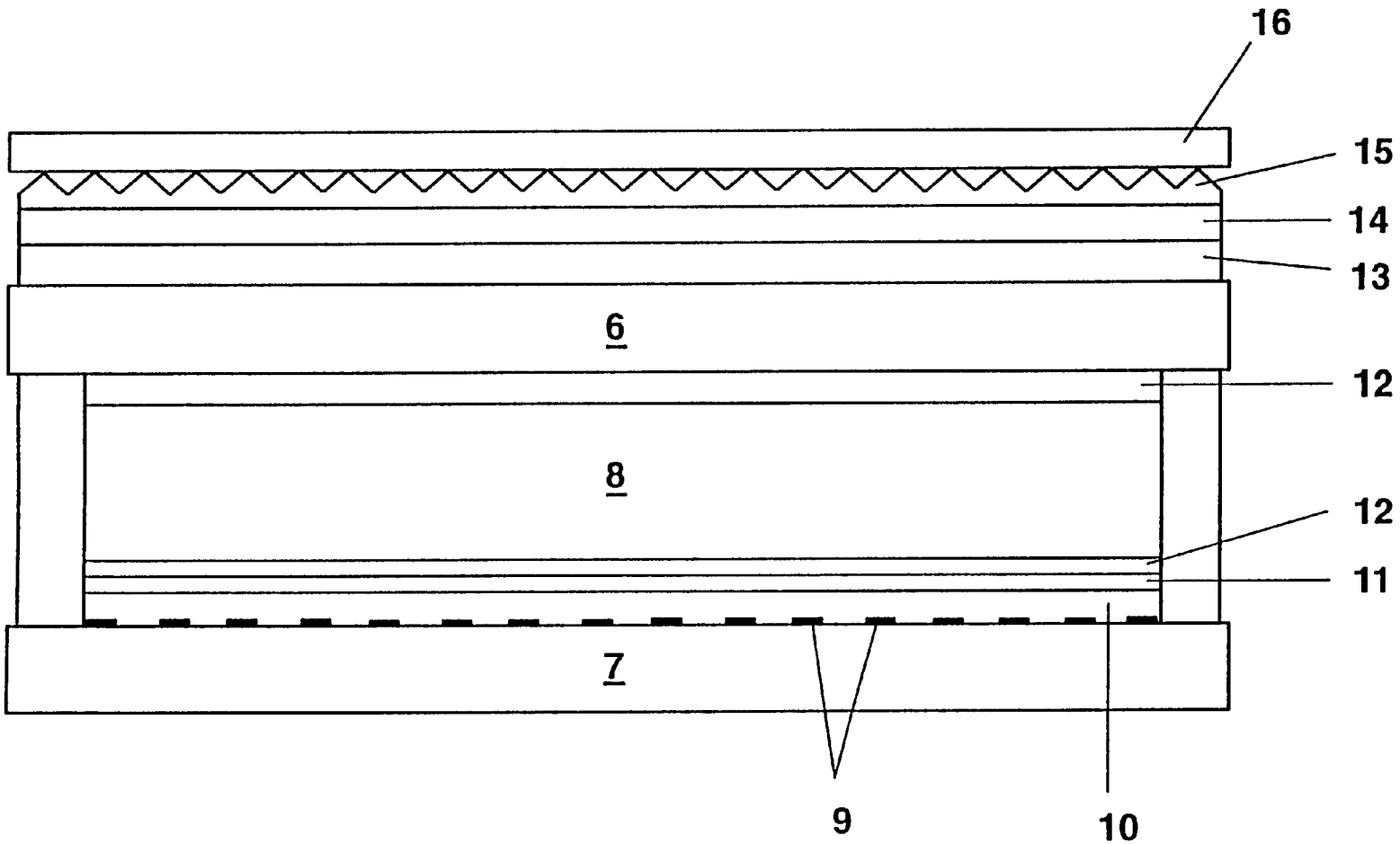
FIG. 2 is a side view in section through the signal lamp.

In the case of signal lamps in motor vehicles, the freedom of choice in terms of shape is of major significance with a view to vehicle body design. In the simplest case, the signal lamps shown in FIGS. 1–3 can also be imagined as a round red tail light or a round yellow turn indicator for a passenger car. The lamp can also curve around a corner of the vehicle. This can be advantageous above all for tail lights, brake lights or turn indicator lights, which others involved in the traffic can see even from the side of the vehicle. Since the invention makes it possible to construct especially shallow motor vehicle lights, they can be wrapped around a vehicle corner in this way without extending deep into the vehicle body as conventional lights do.

What is claimed is:

1. A signal lamp comprising:

a discharge vessel which is at least partly transparent to visible radiation, and which is filled with a gas fill and provided with at least one discharge electrode, and a dielectric layer which is provided between the at least one discharge electrode and the gas fill to effect a dielectrically impaired discharge in the discharge vessel, wherein the discharge vessel comprises a continuous boundary surface that functions as a signal surface of the signal lamp.

2. The signal lamp of claim 1, wherein the at least one discharge electrode comprises a plurality of discharge electrodes that are disposed on a face of the discharge vessel opposite the signal surface.

3. The signal lamp of claim 1, wherein a plurality of parallel-extending discharge anodes and discharge cathodes are each interconnected on one common side of the anodes and cathodes, respectively, and are connected to a single anode terminal and a single cathode terminal, respectively.

4. The signal lamp of claim 1, wherein the at least one discharge electrode comprises protrusions that locally define individual discharge elements of the dielectrically impaired discharge.

5. The signal lamp of claim 1, wherein the at least one discharge electrode comprises a plurality of discharge electrodes and at least some of the discharge electrodes are applied to an outside of one wall of the discharge vessel, and wherein the dielectric layer is formed by said wall.

6. The signal lamp of claim 1, wherein a reflective layer is provided on a side of one wall of the discharge vessel to effect diffuse reflection of light from the signal lamp.

7. The signal lamp of claim 1, wherein a diffuser is provided on a side of the continuous boundary surface of the discharge vessel.

8. The signal lamp of claim 7, wherein a light density enhancement layer is disposed on a side of the continuous boundary surface of the discharge vessel and the diffuser.

9. The signal lamp of claim 8, wherein the light density enhancement layer comprises two brightness enhancement foils intersecting at right angles in a longitudinal prism direction thereof.

10. The signal lamp of claim 1, wherein the signal lamp effects a xenon excimer discharge.

11. The signal lamp of claim 1, wherein the signal lamp is operated by a pulsed energy supply.

12. A traffic sign or signal comprising the signal lamp of claim 1.

13. The traffic sign or signal of claim 12, wherein said traffic sign or signal is structured as a traffic light.

14. The traffic sign or signal of claim 12, wherein said traffic sign or signal is structured as a motor vehicle light.

15. The traffic sign or signal of claim 14, wherein said motor vehicle light comprises one of a curved tail light, brake light and turn indicator light extending around a corner of a vehicle.

16. The signal lamp of claim 8, wherein the light density enhancement layer comprises one of a prism foil, prism plate, and Fresnel lens.

17. The signal lamp of claim 9, wherein the two brightness enhancement foils are prism foils.

* * * * *